US005150122A

United States Patent [19]

Bell

[11] Patent Number: 5,150,122

[45] Date of Patent: Sep. 22, 1992

[54] MILITARY AIRCRAFT

[75] Inventor: Stephen W. Bell, Suffolk, England

[73] Assignee: GEC-Marconi Limited, England

[21] Appl. No.: 81,809

[22] Filed: Jul. 21, 1987

[30] Foreign Application Priority Data

Jul. 22, 1986 [GB] United Kingdom ..... 8617912
Jul. 22, 1986 [GB] United Kingdom ..... 8617914
Jul. 22, 1986 [GB] United Kingdom ..... 8617916
Jul. 22, 1986 [GB] United Kingdom ..... 8617919

[51] Int. Cl.[5] ..... H01Q 15/20

[52] U.S. Cl. ..... 342/8; 342/10; 342/13

[58] Field of Search ..... 342/2, 3, 4, 5, 7, 8, 342/9, 10, 13, 16, 14

[56] References Cited

U.S. PATENT DOCUMENTS 2,310,790 2/1943 Jungersen ..... 342/7 X
2,436,578 2/1948 Korn et al. ..... 342/2 X
2,721,998 10/1955 Holm ..... 342/8
2,780,806 2/1957 Van Alstyne ..... 342/7
2,879,999 3/1959 Marshall ..... 342/5 X
2,898,588 8/1959 Graham ..... 342/8
3,010,103 11/1961 Hopper et al. ..... 342/9
3,127,608 3/1964 Eldredge ..... 342/2
4,028,701 6/1977 Parks et al. ..... 342/8
4,037,228 7/1977 Pearson ..... 342/7
4,195,298 3/1980 Firth ..... 342/8
4,352,106 9/1982 Firth ..... 342/7
4,551,726 11/1985 Berg ..... 342/7
4,700,190 10/1987 Harrington ..... 342/2

*Primary Examiner*—John B. Sotomayor
*Attorney, Agent, or Firm*—Larson and Taylor

[57] ABSTRACT

An aircraft (1) includes a radar reflector (2) arranged so that the radar signature of the combination of aircraft (1) and reflector (2) is different from that of the aircraft (1) alone. This confuses enemy radar either by removing or folding flat the reflector (2) when on a combat mission so that the aircraft (1) on its own has a surprisingly low radar cross-section; or, alternatively by making radar signature of the combination correspond to that of an aircraft of a potential enemy.

16 Claims, 8 Drawing Sheets

MILITARY AIRCRAFT

BACKGROUND OF THE INVENTION

Modern military aircraft are designed to have as low a radar return or cross-section as possible in an attempt to enable them to evade interception and attack by a radar defence system during a combat operation. It is possible to reduce the radar return or cross-section of an aircraft by modifying its shape, by having the aircraft made from materials which do not reflect radar and by using a material which absorbs electromagnetic radiation to cover those parts which have to be made of a material which reflects electromagnetic radiation.

In spite of the best endeavours which have been made so far all aircraft still provide some radar return and the particular return or radar signature which is obtained from an aircraft is distinctive of aircraft of that particular type. Modern radar systems analyse the radar return which is obtained and use this to give an indication of the type of aircraft. For example, modern radar compares the radar signature of an aircraft at two or more different frequencies and analyses the return for different polarisation states. Phased array radars are particularly discriminating. Typically, at least part of the radar return is sampled to monitor changes that take place as part of its threat assessment. A radar defense system is usually programmed with the radar signatures of that country's own, and other friendly aircraft and also programmed with the radar signatures of those aircraft which are operated by potential enemies. The radar defence system is sometimes controlled so that it will only launch an attack on aircraft which has been identified as having a radar signature corresponding to that of a potential enemy. It is relatively easy for any country to be able to get information on the radar signature of aircraft operated by its potential enemies whilst these aircraft are taking part in training exercises. Thus, at present, it is virtually impossible to keep the radar signature of any aircraft secret and thereby prevent it being recorded and built into a radar defence system of a potential enemy as an enemy aircraft.

SUMMARY OF THE INVENTION

According to this invention an aircraft includes a radar reflector arranged so that the radar signature of the combination of aircraft and reflector is different from that of the aircraft alone.

When the aircraft has a very low radar cross-section so that, on its own it provides a very low radar return, the present invention causes the aircraft and radar reflector combination to have a significant radar cross-section and so to give a significant radar return. The return from the radar reflector swamps the radar signature of the aircraft alone. This firstly lulls a potential enemy into a false sense of security, since the potential enemy believes that the aircraft has a significant radar cross-section and so can be readily identified by its radar defence system and secondly it ensures that the radar signature that is programmed into a radar defence system of a potential enemy corresponding to that particular variety of aircraft is that of the aircraft plus its radar reflector. Thus, the potential enemy does not have any record of the radar signature of the aircraft alone. The aircraft whilst exercising always has the radar reflector deployed and it is only when the aircraft is on a combat operation that the radar reflector is not deployed so taking a potential enemy by surprise both in the smallness of the radar cross-section of the aircraft and the corresponding weakness in the radar return that is obtained from it and by the particular radar signature being one which is not programmed in to their radar defence system.

Another way in which the present invention is used is to have the radar reflector modifying the existing radar signature of an aircraft. In this way, it is possible to have the combination of aircraft and radar reflector provide a signature which is different to that of the aircraft alone. When arranged in this way the aircraft normally would have the radar reflector not deployed so that, whilst exercising the aircraft would give its "normal" radar signature and then only deploy the radar reflector when on a combat operation so that, under these circumstances, it provides a signature which is not already programmed into the enemy's radar defence system and so does not enable the enemy's radar defence system to identify whether the aircraft is a friend or foe.

It is very much preferred that the radar signature of the combination of the aircraft and radar reflector corresponds to that of an aircraft of a potential enemy. In this way, the enemy's radar defence system picks up an attacking aircraft but identifies it as one of its own and so does not attack it.

Preferably the radar reflector includes an array of trihedral re-entrant corner reflecting elements oriented relative to one another so that a radar beam incident upon the array is reflected from more than one reflecting element at the same time. In this way the beams reflected from the more than one element interfere with one another to provide a fine structure in the reflected signal which corresponds closely to that reflected from an aircraft as a result of interference between reflections from different parts of it.

Modern radar systems often use a particular polarisation state for the radar signal partly to discriminate a true echo from a potential attacker or target from background clutter caused, for example, by a rough sea or surrounding surface features and partly to be able to identify an attacker or target from a signal generated by electronic countermeasures fitted to the aircraft or by echoes given off a radar reflecting decoy like chaff. Conventionally chaff is formed by thin strips of metallised foil of dipole length which are ejected from an aircraft. The response from a cloud of chaff is isotropic. The echo from a real aircraft is invariably polarised in some way or another as a result of multiple reflections from two or more surfaces of the aircraft. Thus when a polarised radar signal interacts with an aircraft the return echo and hence its radar signature will vary with the polarisation state of the radar used. In view of this it is possible for a radar system to discriminate between a false echo generated by chaff or decoys and that resulting from a real aircraft by monitoring its polarisation state.

Accordingly it is preferred that the radar reflector also includes dihedral re-entrant corner reflecting elements.

A radar reflection from a dihedral re-entrant corner is strongly polarised in the plane containing the dihedral corner between the two surfaces which make up the dihedral element. By mixing different types of reflecting elements and varying their mutual orientation and phase relationship it is possible to tailor the radar signature of the reflector so that it corresponds to that of an aircraft. Additional lateral plates may be included on one or both faces of each dihedral element which extend normally or at an angle to the faces.

Naturally when it is desired that the radar signature of the combination of the aircraft and the reflector has a particular configuration, the reflection from the radar reflector and its location on the aircraft must be arranged so that the reflection from the reflector interferes with that from the remainder of the aircraft to give the required radar signature for the combination. In some instances it may be desirable to have more than one radar reflector located on the aircraft so that the relative location of the two or more provides a particular phase relationship between them.

Modern radar is often of the so-called agile type which rapidly switches between different frequencies as it scans. This rapid switching between frequencies is partly to overcome the effect of electronic counter measures and partly to help it to discriminate between a cloud of chaff ejected from a potential target as a decoy and the target. In practice it is very difficult to attempt to match the length of the pieces of chaff with the dipole length of the wavelengths of an agile radar system.

A radar reflector with reflecting elements of constant size would give a proportionally different response to radar at different frequencies. It is therefore preferred that the radar reflector includes an array of trihedral re-entrant corner reflecting elements with the size of some of the elements being different to that of other of the elements in the array.

When a radar reflector includes trihedral reflecting elements of different size it provides a radar reflection which corresponds to that of an aircraft over a wide range of incident radar wavelengths.

The different size of the trihedral re-entrant corner reflecting elements may be created by having the separator plate located between each pair of faces in each dihedral element being offset from the centre of the corner between adjacent faces of each dihedral element to provide a large and a small trihedral re-entrant corner reflecting element in each dihedral element. Alternatively each separator plate is located substantially centrally along the corner between the two faces of each dihedral element and it is the size of the faces that make up each dihedral element that differs. When the radar reflector is folded from sheet material it may be folded from a sheet of material the size of which tapers so that the size of each trapezium-shaped plate increases from one end to the other to provide a reflector in which the size of each trihedral re-entrant corner reflecting element is different from one another. Reflectors can also be made so that the largest size of reflecting element is in the middle of the reflector or at both ends of the reflector so that it is "waisted" in the middle.

The or each radar reflector may comprise a number of trihedral re-entrant corner reflecting element strings with the reflecting elements in each string being located on the surface of a solid of revolution having an axis and the strings being connected together to form a single reflector with the axes of the strings being displaced from one another.

The axes of the strings of reflecting elements may each be generally straight and in this case their axes may be arranged substantially parallel to one another or may be arranged at an angle to one another. When the axes of the strings of reflecting element arrays are generally parallel to one another the return echoes from the strings reinforce one another and so reflect a greater quantity of radar signal to provide a strong echo.

Alternatively the radar reflector may comprise a single string of trihedral re-entrant corner reflecting elements arranged so that their origins are located on the surface of a solid of revolution having a curved axis. The curved axis may comprise a circle and in this case the reflector occupies a toroidal volume. Preferably, however, the axis of the solid of revolution does not lie in a single plane and preferably it comprises a helix or sinuous path around the surface of a sphere, elipsoid or other solid having a curved outer surface.

With such a radar reflector the individual reflecting elements that reflect an incident beam do not all receive the incident radar wavefront at the same instant and therefore a phase difference exists between their reflections. This gives rise to constructive and destructive interference between the overlapping reflected beams and this generates a fine structure in the radar signature of the reflector which closely resembles that obtained from an extended object such as an aircraft. Thus the radar return obtained from such a radar reflector mimics that obtained from an aircraft closely.

One tell-tale radar analysis of an aircraft involves monitoring the radar echo for any doppler shift, not just to indicate movement of the aircraft, but to recognise a particular aspect of the aircraft. The radar return from an aircraft engine intake fan or any other rotating part may cause a doppler shift when head-on or tail-on to a radar source. The nature of this doppler behaviour is not related to the speed of the target, but more to the geometry and speed of engine parts. It is not a consistent doppler shift such as that related to target velocity, but a mixed doppler return of faster and slower indications. The object of the aircraft designer is to attempt to minimise this mixed doppler return but it is difficult to eliminate it entirely and accordingly this is often used as a way of discriminating between a real target and a decoy.

When a radar reflector having reflecting elements arranged with their origins on the surface of a solid of revolution is rotated it provides such a mixed radar return. The rotation may be provided by mounting at least part of the reflector for rotation and providing a drive to rotate it. It is not necessary for the reflector to spin at the same speed as a gas turbine to get a sufficiently confusing effect. With such an arrangement it is possible to mimic the radar signature of a real aircraft so that it is substantially indistinguishable.

Preferably the or each radar reflector is arranged to fold so that all of its elements are substantially flat. When folded a reflector has a very small radar cross-section and thus, in this state is not deployed. The or each reflector may be spring biassed into its or their erected and deployed position so that it or they can be erected automatically. It is also possible to change the shape and configuration of the radar reflector by folding part of it so that it changes its radar signature. In this way the or each reflector can have two or more different reflective states which it can deploy.

BRIEF DESCRIPTION OF THE DRAWINGS

Particular examples of an aircraft and a radar reflector for use with an aircraft having a low radar signature is shown in the accompanying drawings, in which.

DESCRIPTION OF PREFERRED EXAMPLES

Figure 1:
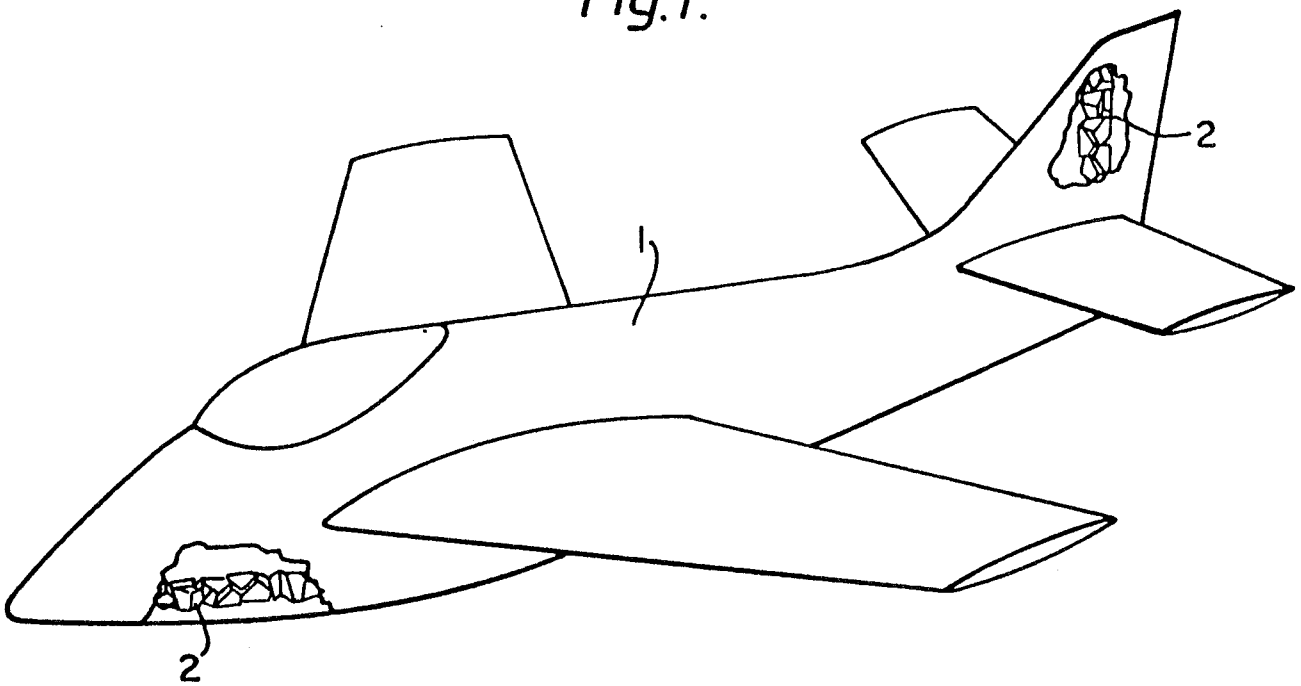
FIG. 1 is a perspective view of an aircraft.

FIG. 1 shows an aircraft 1 having two radar reflectors used to provide the significant radar return for the aircraft 1 which, otherwise, would have a very low radar cross-section. The return from the reflectors 2 is used to mask the radar signature of the aircraft 1. The reflectors 2 are preferably covered by radar transparent radomes (not shown). Particular examples of reflectors suitable for use as the or as one of the reflectors 2 are described alone subsequently.

Figure 2:
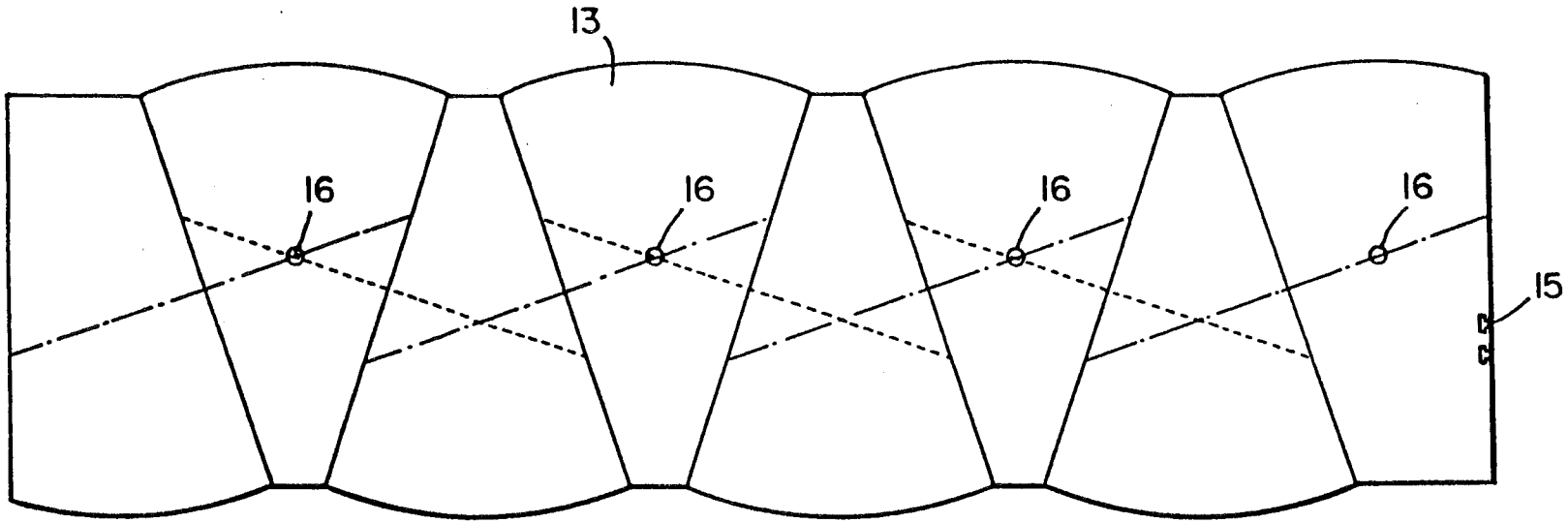
FIG. 2 is a plan of a main part of a first example of reflector.
Figure 3:
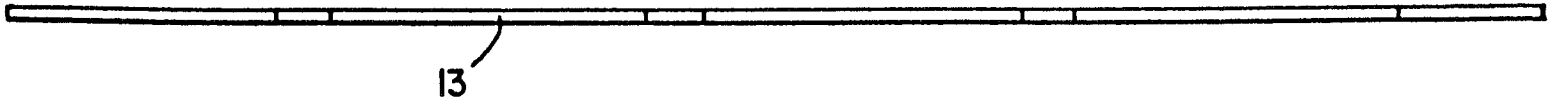
FIG. 3 is a side elevation of the main part of the first reflector.
Figure 4:
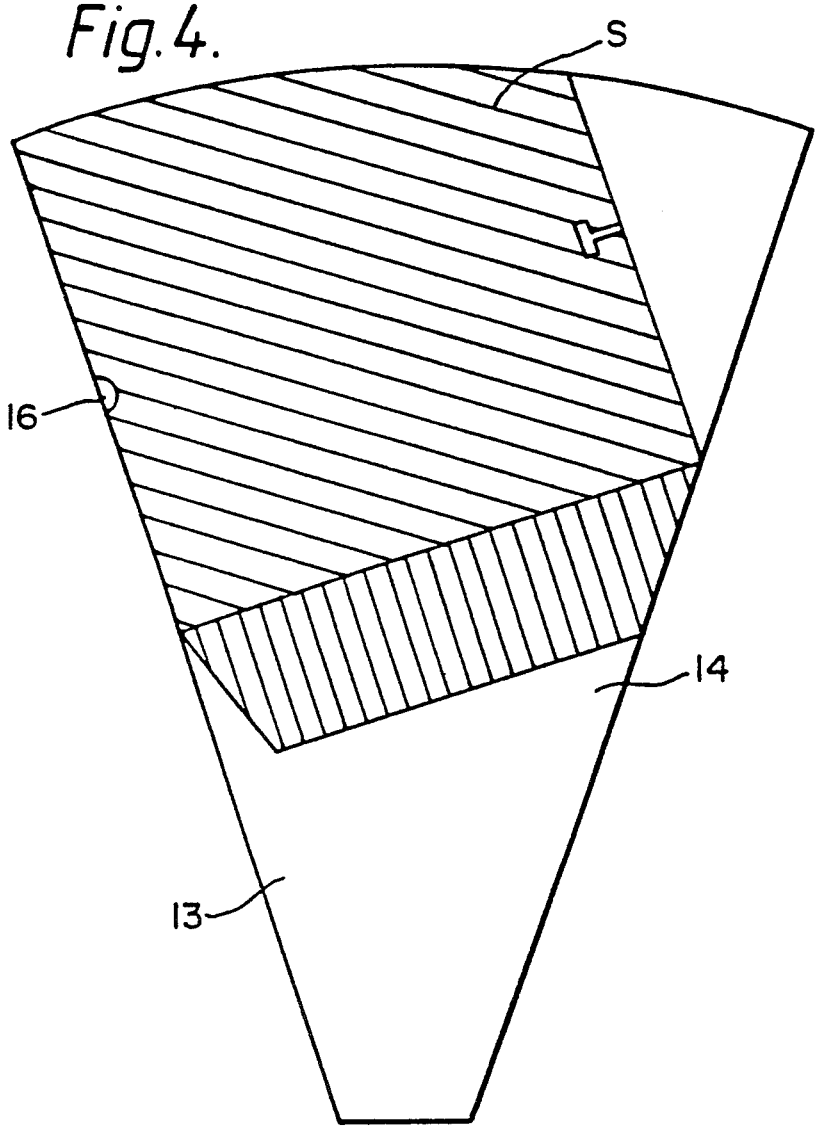
FIG. 4 is a plan of one segment of the main part of the first reflector with attached separator plate drawn to a larger scale.
Figure 6:
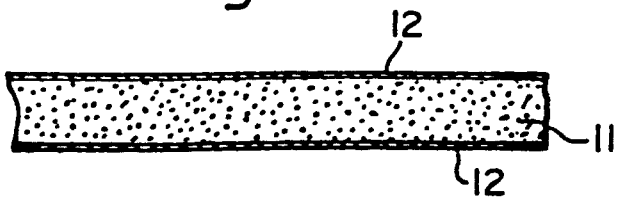
FIG. 6 is a cross-section drawn to an even larger scale through part of the material used to form the first example of reflector.
Figure 5:
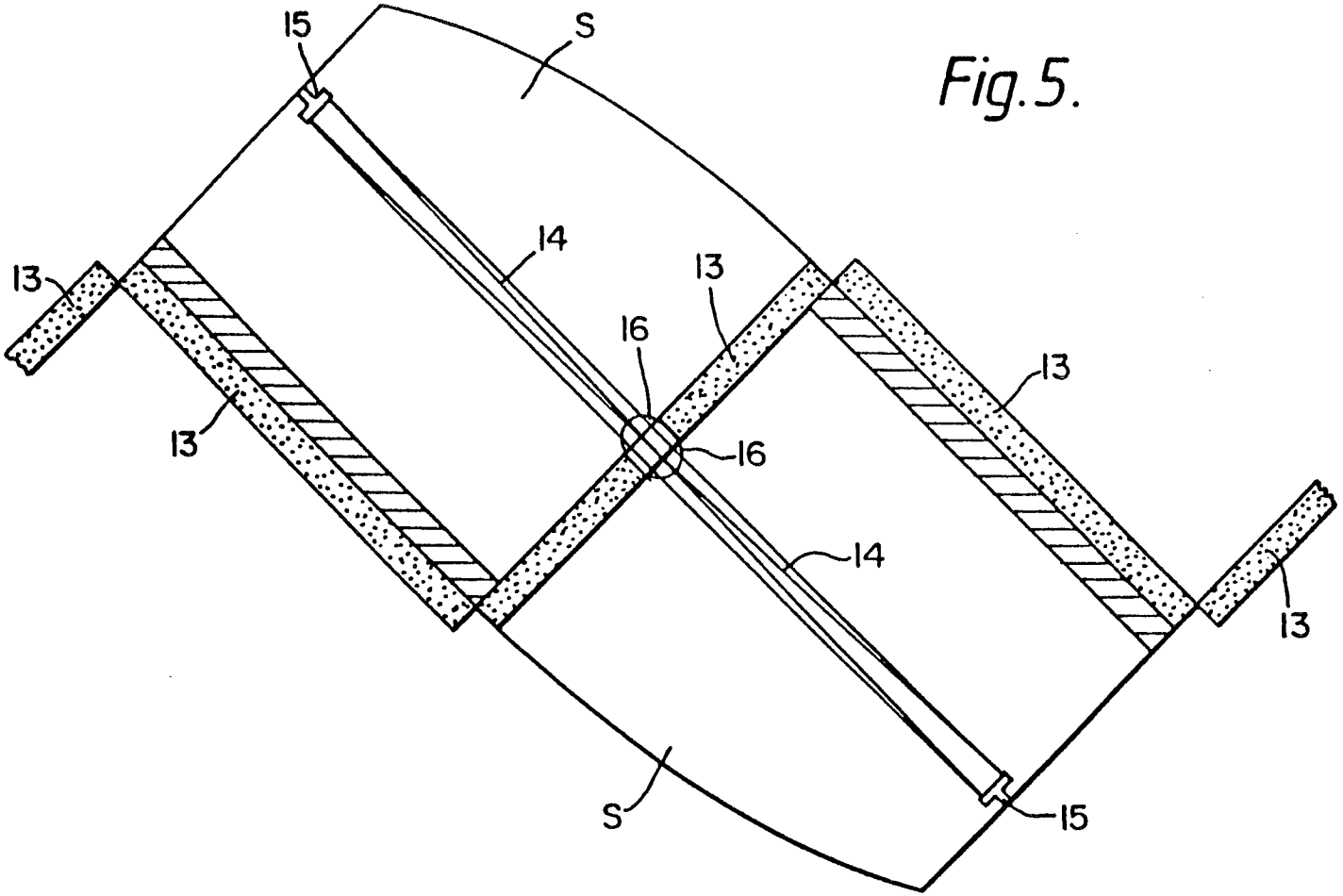
FIG. 5 is a cross-section through part of the first example of reflector in an assembled condition and drawn to a larger scale.

The first example of reflector is made from a core of rigid foam material 11 having metallised polymer film 12 bonded onto both faces as shown in FIG. 6. A main part 13 is formed by six identical elements T2 to T7 having one curved side and arranged so that alternate elements are laterally reversed as shown in FIG. 2. Two further identical elements T1 and T8, again laterally reversed relative to one another and again having one curved face are arranged at the ends of the elements T2 to T7. The main part 13 is arranged to fold along the lines between adjacent elements T1 to T8 with the folds F1, F3, F5 and F7 being in one direction and the remaining folds being in the opposite direction. The elements are folded so as to lie at 90° to their neighbours as shown in FIG. 5. Separator plates S are hinged onto one side of each of the elements T1 to T8 as shown in FIG. 4. As the elements are folded the separator plates S are also folded so as to lie substantially normally to a particular element upon which they are located again as shown most clearly in FIG. 5. Springs 14 of rubber, or rubber-like elastomeric material are threaded through slots 15 and holes 16 and tend to pull the separator plates and main part 13 into their assembled position. However, the rubber or rubber-like elastomeric springs 14 can be stretched to allow the reflector to fold flat.

When in its erect position, a pair of re-entrant trihedral reflecting elements are formed between each adjacent pair of elements T1 to T8 and the corresponding separator plate S. There is one re-entrant trihedral reflector formed on each side of each separator plate S. In FIG. 2 the chain dotted line shows the final position of the separator plates S on one side of the elements whilst the dotted line shows the final position of the separator plates S on the opposite side of the elements. The curved edges on the elements T1 to T8 and separator plates S provide a cylindrical outer profile to the assembled reflector.

Figure 7:
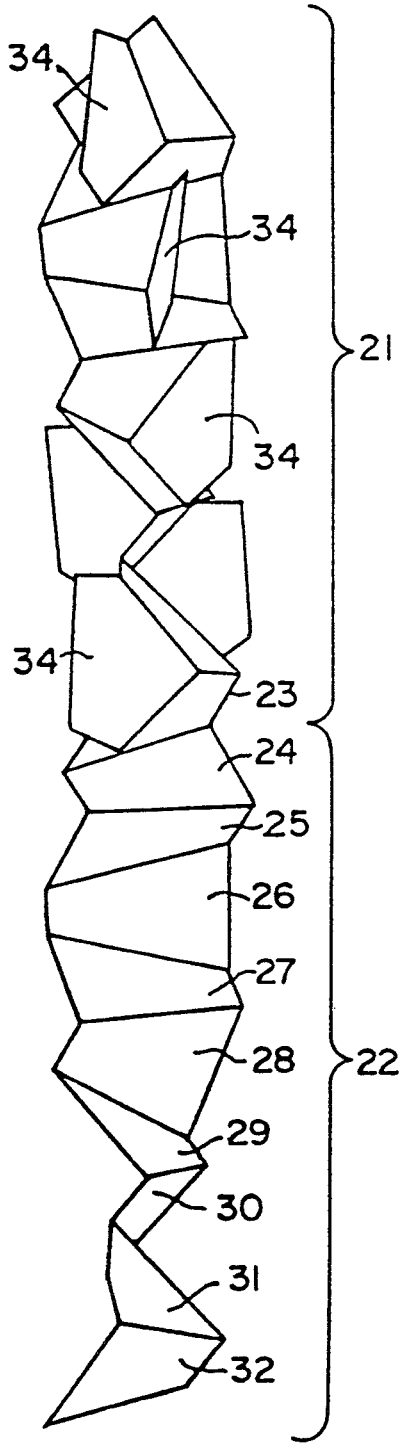
FIG. 7 is a perspective view of a second example of reflector.
Figure 9:
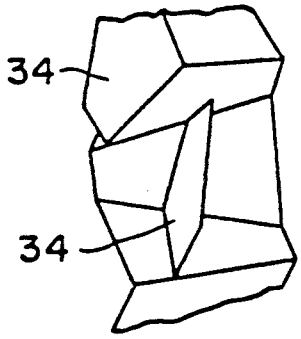
FIG. 9 is a scrap perspective view of another modification of the second example of reflector.

A second example shown in FIG. 7 comprises an upper section 21 which is essentially a standard trihedral re-entrant corner reflector such as described in British patent specification 681,666 and a lower section 22 which is formed by a series of trapezium-shaped plates 23, 24, 25, 26, 27, 28, 29, 30, 31 and 32 which are angled at 90° to one another and form a series of nine dihedral reflecting elements. Typically the reflector is folded from a strip of sheet aluminium with the separator plates connected to it with blind rivets (not shown).

Figure 8:
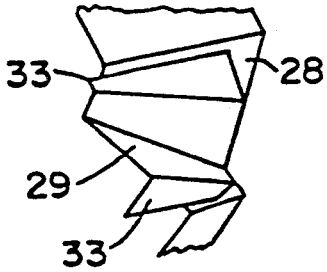
FIG. 8 is a scrap perspective view of a modification of the second example of reflector.

A modification of this example is shown in FIG. 8. In this modification additional lateral plates 33 are located on the trapezium-shaped plates 28 and 29. Such lateral plates may be included in all or selected ones of the plates 23–32. Again they may be connected by blind rivets. The radar reflection from the second example is polarisation dependent.

Figure 10:
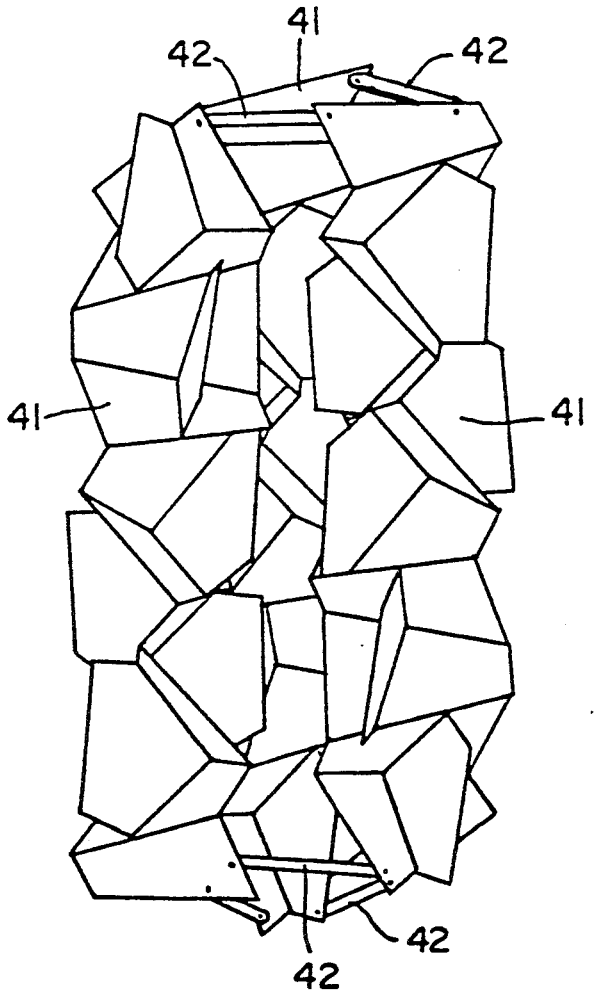
FIG. 10 is a perspective view of a third example of reflector.

A further modification is shown in FIG. 10. In this modification separator plates 34 in the trihedral re-entrant corner upper section 21 are displaced from a central location shown in FIG. 7 to an off-centre location.

In the third example three standard trihedral re-entrant corner reflectors 41 such as those described in British patent specification 681,666 are connected together side-by-side by links 42 with their axes parallel to one another. Each standard reflector 41 is optimised to give its maximum reflection in a direction away from its neighbours to maximise the reflections from the complete reflector.

The strips of material shown in FIG. 11 are marked with lines indicating where they are folded. The solid lines represent a fold with the arris facing out of the plane of the paper and the dotted lines indicating a fold with the arris facing into the plane of the paper. Folding such strips to provide trapezium-shaped faces so that an angle of 90° is included between adjacent trapezium-shaped faces provides the basic element of a trihedral re-entrant corner reflector as described in British Patent Specification 681,666 and as shown in FIGS. 7 and 10. Separator plates (not shown in this Figure) are installed between each pair of adjacent trapezium-shaped plates and are typically located centrally along the corner extending between adjacent trapezium-shaped plates but they may be offset and located towards one side edge or the other side edge of the strip. In this way, trihedral re-entrant corner reflecting elements of different size can be produced.

Figure 11A:
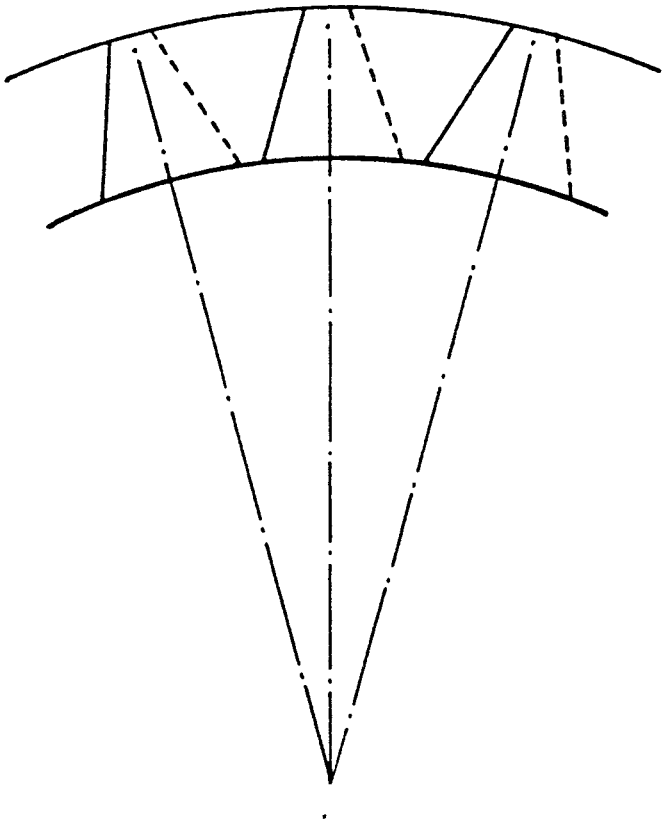
FIGS. 11*a* to 11*d* are a series of plans of strips before folding to make other examples.

FIG. 11*a* illustrates a blank for forming a reflector which is made from a blank the sides of which are curved. When this blank is folded as indicated in FIG. 11*a* a generally cork-screw or helically shaped radar reflector is produced. The origins of the trihedral reflecting elements lie on the surface of a solid of revolution having a helical axis.

Figure 11B:
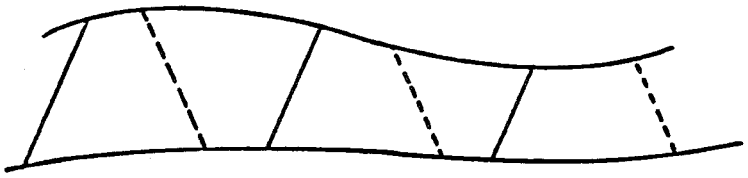

FIG. 11*b* illustrates a blank in which different and unrelated curves are used for each side of the blank. The radar reflector resulting from this forms a tapering cork-screw with different sized reflecting elements located along its length.

Figure 11C:
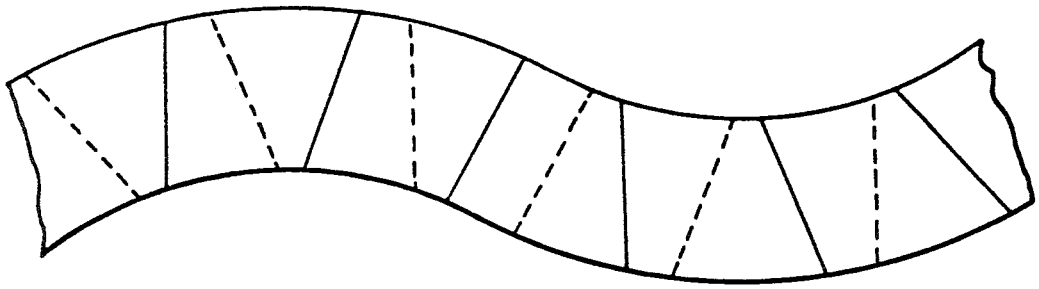

FIG. 11*c* is folded to produce a reflector which is shaped like a helix which reverses its direction of rotation half way along. The origins of its trihedral reflecting elements lie on the surface of a solid of revolution which has a helical axis which again reverses its direction of revolution half way along.

Figure 11D:
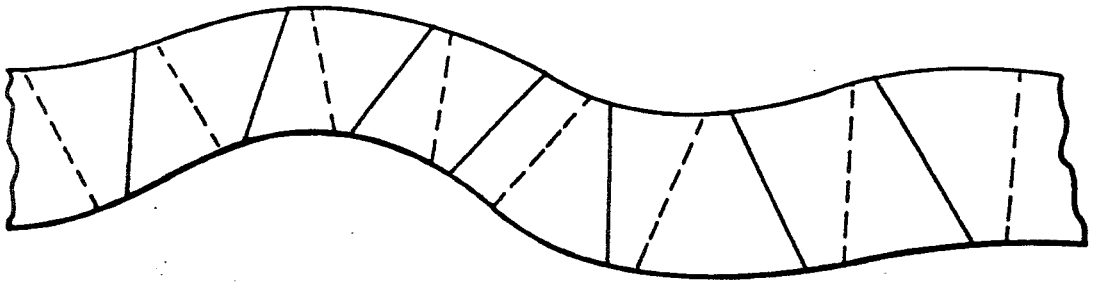

FIG. 11*d* is folded to produce a reflector which is similar to that shown in FIG. 11*c* but the pitch of which varies.

Multiples of any of the structures shown in FIG. 11, or combinations of them may be used in combination to give complete structures similar to that shown in FIG. 10.

I claim:

1. In combination, an aircraft of a first radar cross-section providing a first radar return; a selectably deployable radar reflector means, including at least one radar deflector mounted on the aircraft, for, in combination with the aircraft, providing a radar cross-section which differs from said first radar cross-section and which corresponds to that of a different aircraft, and thus providing a radar return corresponding to that of said different aircraft when said radar reflector means is deployed; and means for providing that the radar reflector means is not deployed during normal operations of the aircraft so that the radar signature of the aircraft stored and used by any radar defense system which detects the aircraft during such normal operations will be that of the aircraft alone, and for providing deployment of the at least one radar reflector during a combat operation so that the radar signature of the aircraft in combination with the radar deflector means will be that of said different aircraft and will be different from that which would have been stored by any radar defense system that detected the aircraft during normal operations thereof.

2. The aircraft of claim 1 wherein said radar reflector includes an array of trihedral re-entrant corner reflecting elements.

3. The aircraft of claim 2, wherein said trihedral re-entrant corner reflecting elements are formed by pairs of plates at right angles to one another to define re-entrant corners between them and form dihedral elements, and separator plates located between said pairs of plates and lying in a plane normal to said re-entrant corners between said pairs of plates, and wherein the size of at least some of said trihedral re-entrant corner reflecting elements is different to that of others of said elements in said array.

4. The aircraft of claim 3, wherein said at least some reflecting elements of different size are created by having said separator plates being offset from centres of said re-entrant corners between adjacent faces of said dihedral elements to provide a large and a small trihedral re-entrant corner reflecting element in each said dihedral element.

5. The aircraft of claim 3, wherein said radar reflector comprises a single string of trihedral re-entrant corner reflecting elements arranged whereby origins of said reflecting elements are located on the surface of a solid of revolution having a curved axis.

6. The aircraft of claim 5, wherein said axis of said solid revolution does not lie in a single plane.

7. The aircraft of claim 3, wherein said separator plates are located substantially centrally along said re-entrant corners of said dihedral elements and wherein the size of said plates that make up each said dihedral element differs.

8. The aircraft of claim 2, wherein said radar reflector comprises a single string of trihedral re-entrant corner reflecting elements arranged whereby origins of said reflecting elements are located on the surface of a solid of revolution having a curved axis.

9. The aircraft of claim 8, wherein said axis of said solid of revolution does not line in a single plane.

10. The aircraft of claim 1, wherein said radar reflector includes dihedral re-entrant corner reflecting elements.

11. The aircraft of claim 10, wherein said radar reflector also includes additional lateral plates on at least one face of each dihedral element, said additional lateral plates extending normally to or at an angle to faces of said dihedral re-entrant corner reflecting elements.

12. The aircraft of claim 1, wherein said radar reflector comprises a number of strings of trihedral re-entrant corner reflecting elements, said reflecting elements in each said string being located on the surface of a solid of revolution having an axis and said strings being connected together to form a single reflector with said axes of said strings being displaced from one another.

13. The aircraft of claim 12, wherein said axes of said strings of reflecting elements are generally straight, and wherein their axes are arranged substantially parallel to one another.

14. The aircraft of claim 1, wherein said radar reflector includes trihedral reflecting elements arranged with their origins on the surface of a solid of revolution, said reflector being mounted for rotation, and a drive to rotate said reflector to provide a radar return having a mixed Doppler shift.

15. The aircraft of claim 1, wherein said radar reflector is arranged to fold whereby, in its folded condition all of its elements are substantially flat and the reflector is not deployed.

16. The aircraft of claim 15, wherein said reflector is spring biassed into an erected, deployed position.

* * * * *